US011543153B1

(12) United States Patent
Lyons et al.

(10) Patent No.: US 11,543,153 B1
(45) Date of Patent: Jan. 3, 2023

(54) GAS-FIRED APPLIANCE AND CONTROL ALGORITHM FOR SAME

(71) Applicant: A. O. SMITH CORPORATION, Milwaukee, WI (US)

(72) Inventors: Jeff L. Lyons, Gray, TN (US); George W. Kraus, II, Johnson City, TN (US); Roy L. Smith, Blountville, TN (US); J. Eric Arnold, Jonesborough, TN (US); Steven L. Tilson, Erwin, TN (US)

(73) Assignee: A. O. Smith Corporation, Milwaukee, WI (US)

( * ) Notice: Subject to any disclaimer, the term of this patent is extended or adjusted under 35 U.S.C. 154(b) by 424 days.

(21) Appl. No.: 16/036,424

(22) Filed: Jul. 16, 2018

Related U.S. Application Data

(63) Continuation of application No. 13/050,480, filed on Mar. 17, 2011, now abandoned.

(60) Provisional application No. 61/315,742, filed on Mar. 19, 2010.

(51) Int. Cl.
*F24H 1/00* (2022.01)

(52) U.S. Cl.
CPC ..... *F24H 1/00* (2013.01)

(58) Field of Classification Search
CPC ..... F24H 1/00
USPC ..... 122/14.22, 504, 14.21, 14.2; 431/14, 18; 700/4, 276, 278
See application file for complete search history.

(56) References Cited

U.S. PATENT DOCUMENTS

| | | | | |
|---|---|---|---|---|
| 3,887,325 | A | 6/1975 | Finger et al. | |
| 4,389,184 | A | 6/1983 | Tanaka et al. | |
| 4,402,663 | A | 9/1983 | Romanelli et al. | |
| 4,445,638 | A | 5/1984 | Connell et al. | |
| 4,583,936 | A | 4/1986 | Krieger | |
| 4,590,771 | A * | 5/1986 | Shaffer | F25D 21/006 62/155 |
| 4,938,684 | A | 7/1990 | Karl et al. | |
| 5,055,825 | A | 10/1991 | Yang | |
| 5,189,963 | A | 3/1993 | Mann | |
| 5,249,739 | A | 10/1993 | Bartels et al. | |
| 5,359,967 | A | 11/1994 | Carter et al. | |
| 5,667,375 | A | 9/1997 | Sebastiani | |
| 5,730,069 | A | 3/1998 | Coolidge et al. | |
| 5,761,092 | A | 6/1998 | Bunting | |

(Continued)

*Primary Examiner* — Steven B McAllister
*Assistant Examiner* — John E Bargero
(74) *Attorney, Agent, or Firm* — Michael Best & Friedrich LLP

(57) ABSTRACT

A gas-fired water heater including a water tank, a combustion chamber, a burner assembly disposed within the combustion chamber, a gas valve for controllably supplying gas to the burner assembly, a temperature sensor coupled to the combustion chamber, wherein the temperature sensor generating a signal related to the temperature of the combustion chamber, and a controller having an electronic processor and memory. The controller is configured to receive the signal at a first predetermined time and at a second predetermined time, calculate a change in temperature based on the signal received at the first predetermined time and the signal received at the second predetermined time, compare the change in temperature to a rate of change threshold to produce a first comparison, and shut the gas valve in response to the change in temperature being less than the rate of change threshold.

9 Claims, 5 Drawing Sheets

(56) References Cited

U.S. PATENT DOCUMENTS

| | | | | |
|---|---|---|---|---|
| 5,791,890 | A | 8/1998 | Maughan | |
| 5,857,262 | A | 1/1999 | Bonnema et al. | |
| 6,030,205 | A | 2/2000 | Maughan | |
| 6,216,683 | B1 | 4/2001 | Maughan | |
| 6,236,321 | B1 | 5/2001 | Troost, IV | |
| 6,265,699 | B1 | 7/2001 | Scott | |
| 6,561,138 | B2 | 5/2003 | Kobayashi et al. | |
| 6,881,055 | B2 | 4/2005 | Bird | |
| 6,957,628 | B2 | 10/2005 | Stretch et al. | |
| 6,958,689 | B2 | 10/2005 | Anderson et al. | |
| 6,964,248 | B2 | 11/2005 | Stretch et al. | |
| 7,167,813 | B2 | 1/2007 | Chian et al. | |
| 7,261,061 | B2 | 8/2007 | Shellenberger et al. | |
| 7,290,502 | B2 | 11/2007 | Kidd et al. | |
| 7,380,522 | B2 | 6/2008 | Kreil et al. | |
| 7,434,544 | B2 | 10/2008 | Donnelly et al. | |
| 7,438,023 | B2 * | 10/2008 | Lee | F23N 5/242 122/14.22 |
| 7,451,725 | B2 | 11/2008 | Garrabrant et al. | |
| 7,647,895 | B2 | 1/2010 | Donelly et al. | |
| 7,728,736 | B2 | 6/2010 | Leeland et al. | |
| 2007/0099136 | A1 * | 5/2007 | Cook | F23N 5/242 431/77 |
| 2008/0078337 | A1 | 4/2008 | Donnelly et al. | |
| 2008/0160470 | A1 | 7/2008 | Holtan et al. | |

* cited by examiner

GAS-FIRED APPLIANCE AND CONTROL ALGORITHM FOR SAME

CROSS REFERENCE TO RELATED APPLICATION

This application claims the benefit of U.S. Provisional Patent Application No. 61/315,742, filed Mar. 19, 2010, and U.S. patent application Ser. No. 13/050,480, Mar. 17, 2011, the contents of both of which are herein incorporated by reference.

FIELD

Embodiments relate to safety control algorithms for gas-fired appliances, such as a gas-fired storage-type water heater. More specifically, the invention relates to control algorithms for gas valves in a gas-fired appliance with a combustion chamber.

Gas-fired appliances may be operated in a variety of environments where lint, dirt, oil and other contaminants may be present. After extended use in such environments, these contaminants may starve the combustion chamber of oxygen, resulting in incomplete combustion and the production of carbon monoxide. It is therefore desirable to provide a system for monitoring conditions within the combustion chamber and to automatically shutdown the gas-fired appliance due to abnormal operating conditions.

SUMMARY

One embodiment provides a gas-fired water heater including a water tank including a water inlet and a water outlet, a combustion chamber, a burner assembly disposed within the combustion chamber, wherein the burner assembly for providing a heat to the water tank, a gas valve for controllably supplying gas to the burner assembly, a temperature sensor coupled to the combustion chamber, wherein the temperature sensor generating a signal related to the temperature of the combustion chamber, and a controller having an electronic processor and memory. The controller is configured to receive the signal at a first predetermined time and at a second predetermined time, calculate a change in temperature based on the signal received at the first predetermined time and the signal received at the second predetermined time, compare the change in temperature to a rate of change threshold to produce a first comparison, and shut the gas valve in response to the change in temperature being less than the rate of change threshold. The controller is further configured to receive the signal at a third predetermined time in response to the change in temperature being equal to or greater than the rate of change threshold, calculate a second change in temperature based on the signal received at the second predetermined time and the signal received at the third predetermined time, compare the second change in temperature to a second rate of change threshold to produce a second comparison, and shut the gas valve in response to the second change in temperature being less than the second rate of change threshold.

Another embodiment provides a method of controlling a gas-fired water heater. The gas-fired water heater includes a water tank having a water inlet and a water outlet, a burner for providing heat to the water tank disposed within a combustion chamber, and a temperature sensor coupled to the combustion chamber. The method includes initiating burner operation by supplying gas to the burner, monitoring a combustion chamber temperature with the temperature sensor, storing a first sensed value of a first combustion chamber temperature at a first predetermined time, storing a second sensed value of a second combustion chamber temperature at a second predetermined time, comparing a difference between the second sensed value of the combustion chamber temperature and the first sensed value of the combustion chamber temperature to a first predetermined rate of change threshold to produce a first comparison, and disabling the burner in response to the difference between the second sensed value of the combustion chamber temperature and the first sensed value of the combustion chamber temperature being less than the first predetermined rate of change threshold. The method further includes storing a third sensed value of a third combustion chamber temperature at a third predetermined time, comparing a difference between the third sensed value of the combustion chamber temperature and the first sensed value of the combustion chamber temperature to a second predetermined rate of change threshold to produce a second comparison, and controllably shutting the gas valve in response to the difference between the third sensed value of the combustion chamber temperature and the first sensed value of the combustion chamber temperature being less than the second predetermined rate of change threshold.

Yet another embodiment provides a controller for a gas-fired water heater. The gas-fired water heater having a water tank including a water inlet and a water outlet, a combustion chamber, a burner for providing heat to the water tank disposed within the combustion chamber, a gas valve for controllably supplying gas to the burner, and a temperature sensor generating a signal, the signal relating to a temperature of the combustion chamber. The controller includes a memory in which data derived from the signal is stored and an electronic processor. The electronic processor is configured to open the gas valve to supply gas to the burner, receive the signal at a first predetermined time and at a second predetermined time, calculate a first change in temperature based on the signal received at the first predetermined time and the signal received at the second predetermined time to produce a rate of change, compare the rate of change to a first rate of change threshold to produce a first comparison, and shut the gas valve in response to the rate of change being less than the first rate of change threshold. The electronic process is further configured to calculate a second change in temperature based on the signal received at the first predetermined time and the signal received at the third predetermined time to produce a second rate of change, compare the second rate of change to a second rate of change threshold to produce a second comparison, and shut the gas valve in response to the second rate of change being less than the second rate of change threshold.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
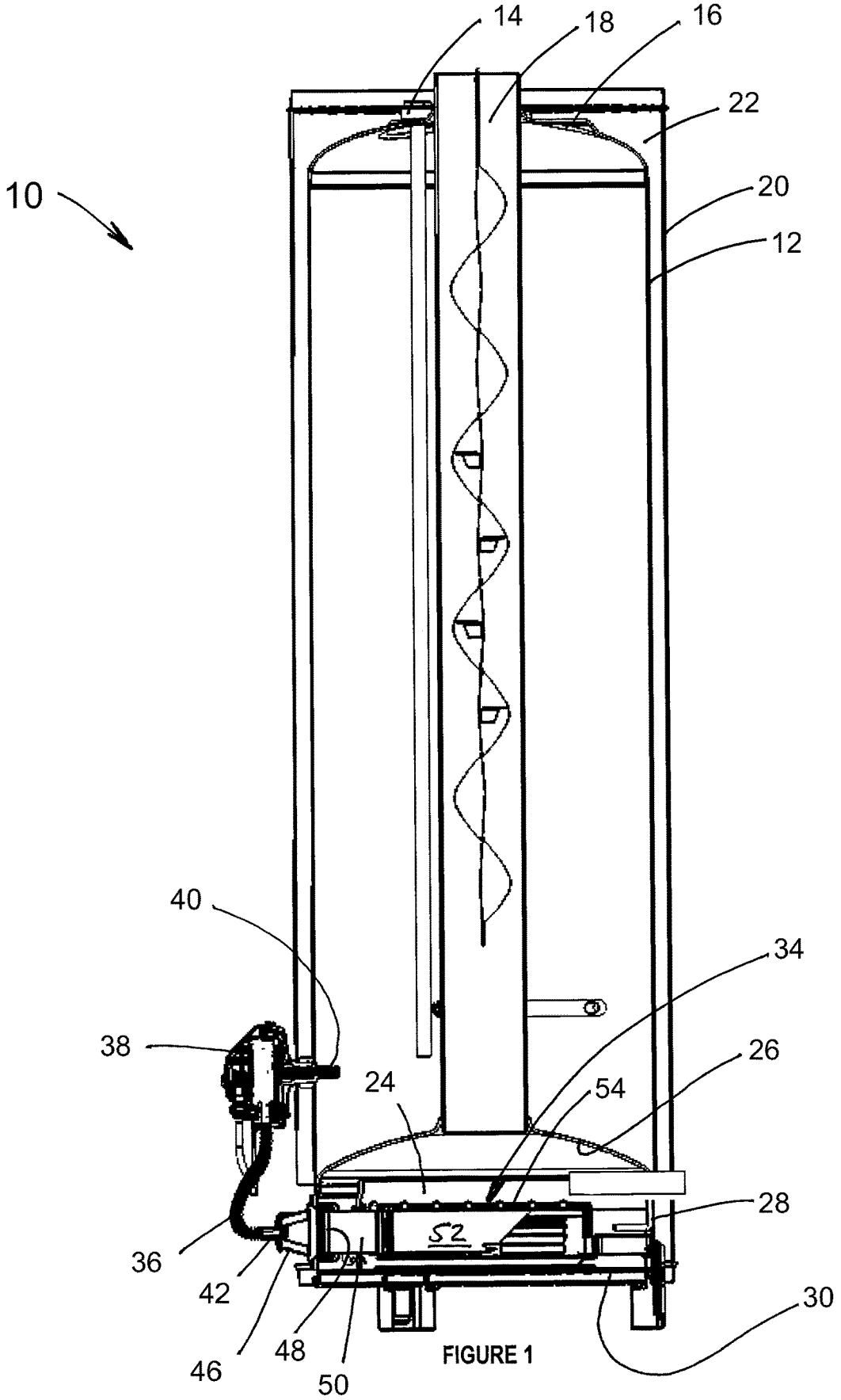
FIG. 1 is a sectional view of a gas-fired water heater.

Turning now to the drawings generally and FIG. 1 in particular, a water heater 10 is shown. The water heater includes a water tank 12 having a water inlet 14 and a water outlet 16. A flue 18 extends upwardly through the tank and outwardly from the top of water heater 10. The tank 12 is surrounded by a jacket 20. A void 22 formed between the tank and the jacket may be filled with foam, fiberglass, or other known insulation types to minimize heat transfer from the tank to the surrounding environment.

A combustion chamber 24 is located below tank 12 and formed by tank bottom 26, a substantially vertically oriented skirt 28, and a bottom pan 30. Bottom pan 30 sits on legs 32. A burner assembly 34 is positioned in combustion chamber 24. The burner assembly 34 receives gas from a gas line 36, which connects to a control module 38. The control module 38 is connected to an external gas supply line. The control module 38 includes an operatively coupled water temperature sensor 40 coupled to the water tank 12. The water temperature sensor 40 generates a signal in response to the temperature of water within the tank. As explained in greater detail below, the control module 38 receives the signal from the temperature sensor in order to maintain water within the water tank at or near a specified temperature set point. In one construction, the water temperature sensor 40 is a negative temperature coefficient (NTC) thermistor.

The gas line 36 connects to a fuel nozzle 42, with the gas line 36 held in a selected position by a mounting bracket 46 adjacent the burner assembly 34. The burner assembly 34 has an opening 48 in the end of a venturi 50. Fuel exits the nozzle 42 and flows directly into opening 48. In operation, fuel is supplied through nozzle 42 to venturi 50 and ambient combustion air is mixed at opening 48 of venturi 50. The air and fuel mixture flows into a plenum 52 and is then combusted along the surface of a screen 54. Primary combustion air is introduced solely through opening 48 in venturi 50.

Figure 2:
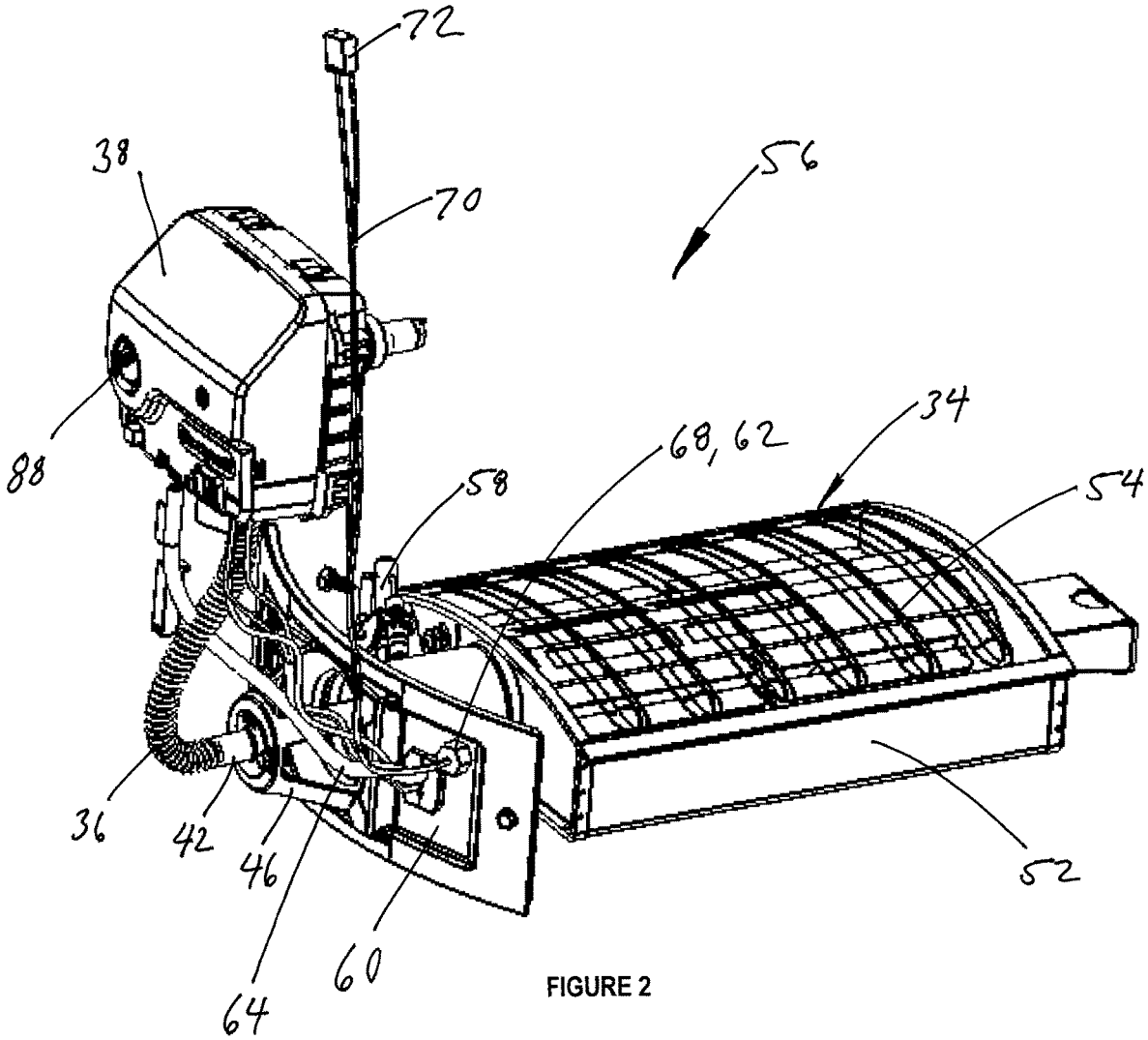
FIG. 2 is a perspective view of a portion of the gas-fired water heater of FIG. 1.

FIG. 2 illustrates a thermal subassembly 56 of the water heater 10. The thermal subassembly 56 includes the burner assembly 34, the control module 38, a pilot burner assembly 58, a combustion chamber door 60, and a combustion chamber door temperature sensor 62. A pilot fuel line 64 extends between control module 38 and the pilot burner assembly 58. As shown in FIG. 2, the plenum 52 is rectangularly shaped, while the screen 54 has a curved profile. The screen 54 may be formed from Inconel®. In one construction, the pilot burner assembly 58 may be a Honeywell™ CS8800 Pilot/Thermopile assembly.

Although the thermal subassembly 56, and in particular the burner assembly 34, is designed for operation in environments where lint, dirt, and oil ("LDO") may be present, such contamination may potentially have an adverse effect on burner operation due to fouling of the screen and opening. Over time, LDO can alter the air/fuel mixture, resulting in incomplete combustion and carbon monoxide production. Due to the risk of carbon monoxide production, governmental and industry standards may require that a fuel-fired appliance, such as the water heater 10, be equipped with a system for shutting down the appliance under conditions where combustion is incomplete due to LDO fouling. One way of detecting LDO fouling and other irregularities in burner operation is by monitoring temperatures within the combustion chamber 22 (FIG. 1) during burner 34 operation.

The combustion chamber temperature sensor 62 is mounted to the combustion chamber door 60. The temperature sensor assembly 62 includes a sensor probe 68, wiring harness 70, and a connector 72. The connector is configured to couple to a corresponding receptacle of the control module 38. In one construction, the sensor probe 68 includes an NTC thermistor coupled to a two-conductor wire harness 70. The wiring harness 70 terminates in a Molex® MINI FIT JR connector 72. The combustion chamber temperature sensor 62 has an operating temperature range of approximately minus 4 degrees Fahrenheit to approximately 302 degrees Fahrenheit.

In the illustrated water heater of FIGS. 1 and 2, the control module 38 is a combination controller and gas supply valve. In one construction, the control module 38 may be a Honeywell® WV8860B controller with a VT8800 gas valve, though other controllers and valves may be applicable to the invention as well.

Figure 3:
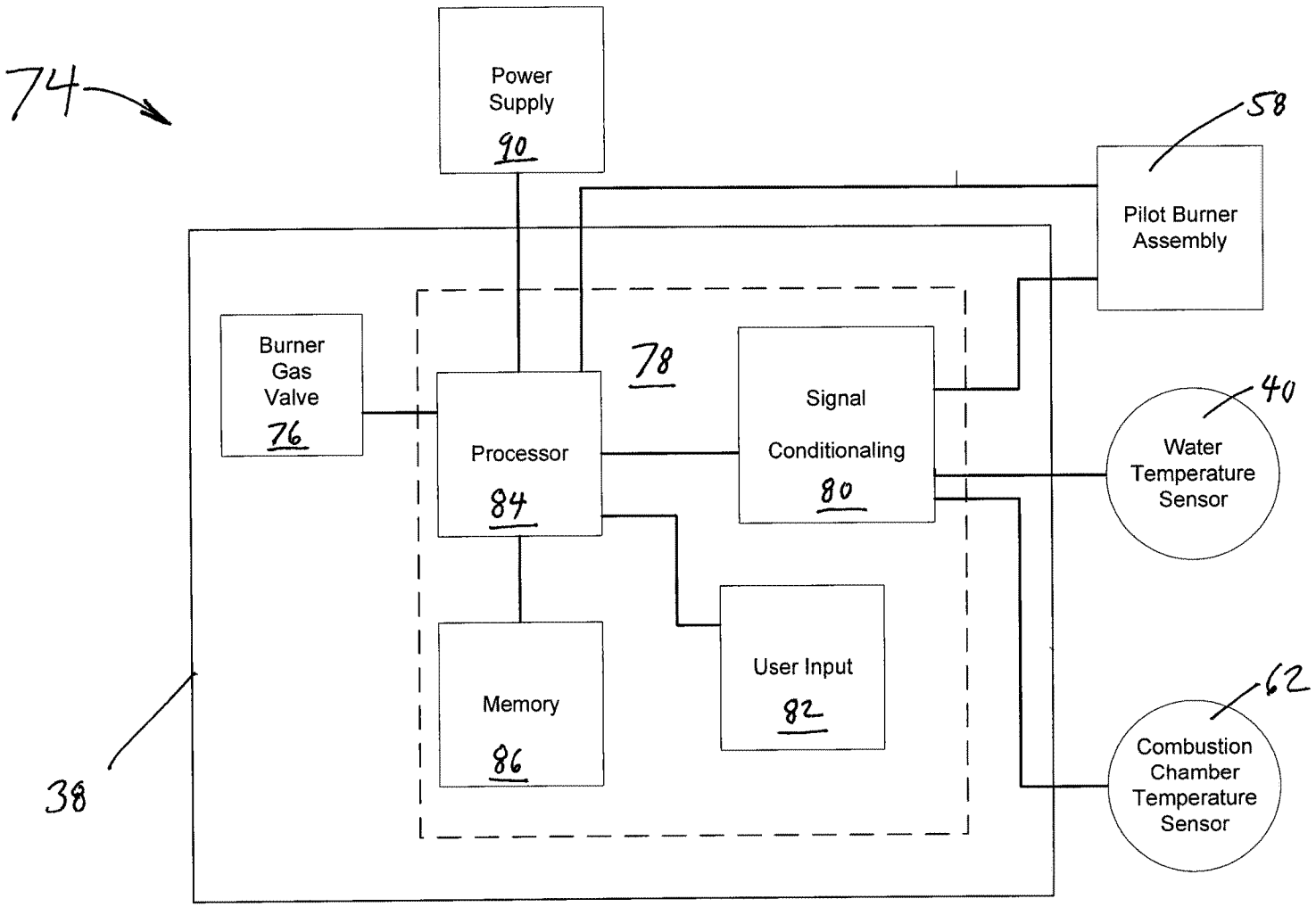
FIG. 3 is a block diagram of a control circuit of the water heater of FIG. 1

FIG. 3 is a block diagram of a control system 74 of the water heater 10. The control system 74 includes the control module 38, the water temperature sensor 40, the pilot burner assembly 58, and combustion chamber temperature sensor assembly 62. The control module 38 includes a gas valve 76 and a controller 78. The controller 78 receives signals from the pilot burner assembly 58, the water temperature sensor 40, and the combustion chamber temperature sensor assembly 62. In one construction, the controller 78 includes a signal conditioning portion 80, a user input portion 82, a processing portion 84, and a memory portion 86. One or more portions 80, 82, or 86 of the controller 78 may be incorporated into or take the form of a microcontroller. It is also envisioned that the portions 80, 82, 84, and 86 may be partitioned differently than shown. For example, the processing portion 84 may include the memory portion 86. Alternatively, the memory portion 86 may include multiple portions, one of which is incorporated in the processing portion 84.

In the illustrated construction, the user input portion 82 includes a knob 88 on the outside of the control module 38 (FIG. 2), by which a user may manually adjust a temperature set point of the water heater 10. The knob 88 may be, for example, a portion of a rheostat assembly. In other constructions, the user input portion 82 can include a combination of digital and analog input or output devices. For example, the user input portion 82 can include a display and input devices such as a touch-screen display, a plurality of knobs, a plurality of dials, a plurality of switches, a plurality of buttons, or the like. The display may be, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, or the like. In other constructions, the display is an active-matrix OLED ("AMOLED") display.

The processing portion 84 may include, for example, a microprocessor or digital signal processor. The processing portion 84 includes combinations of software and hardware that are operable to, among other things, monitor the status of the water tank, combustion chamber and pilot burner control, via signals received from the water tank temperature sensor, the combustion chamber temperature sensor, and the pilot burner thermopile, respectively, and to control their operation based upon those signals. The processing portion 84 may include a clock, counter, or timer.

The memory portion 86 includes, for example, a read-only memory ("ROM"), a random access memory ("RAM"), an electrically erasable programmable read-only memory ("EEPROM"), a flash memory, a hard disk, an SD card, or another suitable magnetic, optical, physical, or electronic memory device. The memory portion 86 may store data for the operation and diagnostics of the water heater 10, including water tank set points, combustion chamber temperature data, pilot burner operational parameters, etc.

A power supply module 90 supplies a nominal AC or DC voltage to the control module. The power supply module 90 is powered, for example, by one or more batteries, a battery pack, an AC line current, the pilot burner thermopile, or any combination of these and other known power sources.

Figure 4:
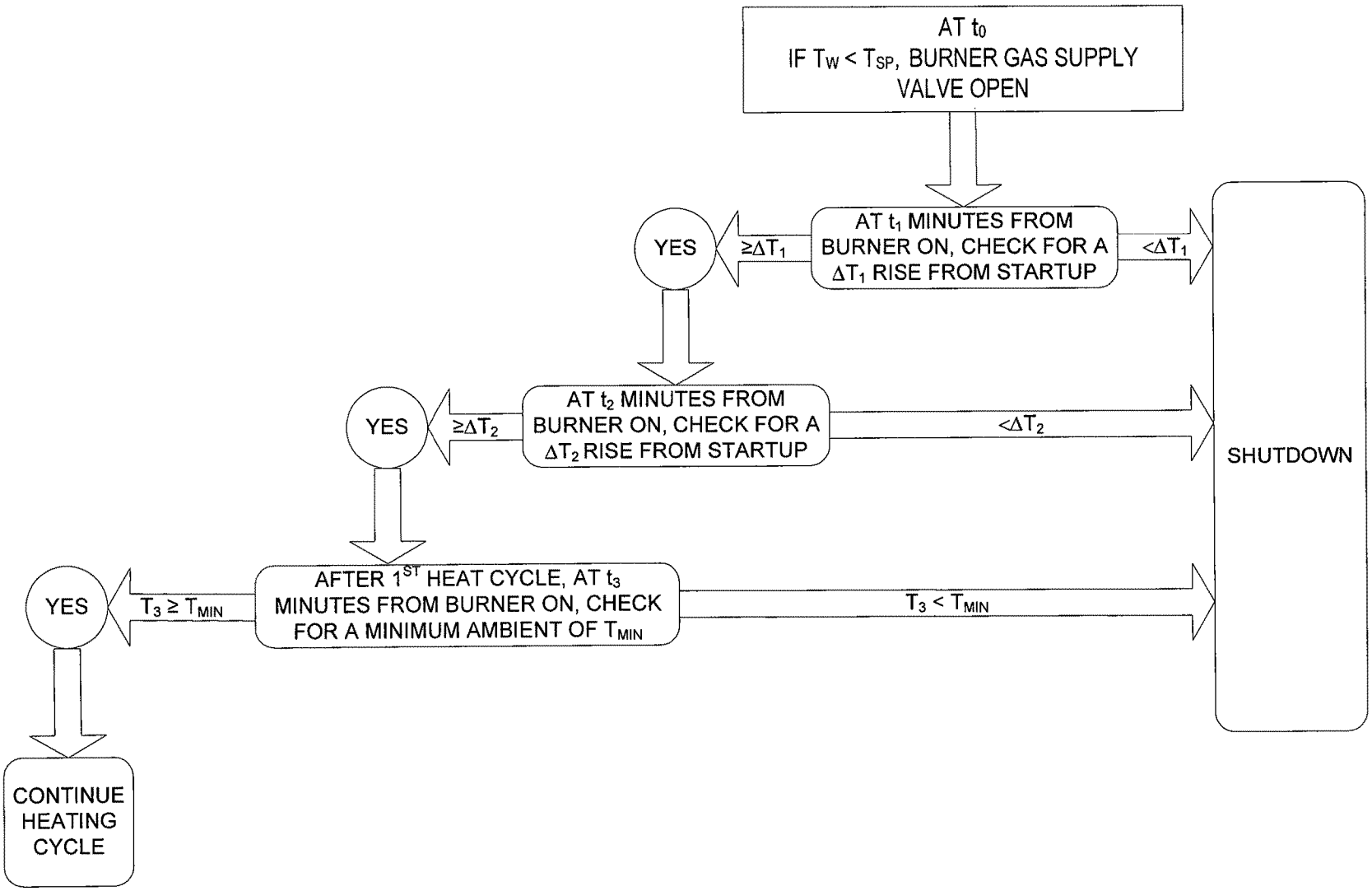
FIG. 4 is a flow chart illustrating a control algorithm for a gas-fired appliance, according to one aspect of the invention

FIG. 4 is a flow chart illustrating one control algorithm for a control module 38 (FIG. 3) of a gas-fired appliance, such as the storage-type water heater 10 described above. Simultaneous reference is made for the following description to FIGS. 1, 3, and 4. Upon system startup, the controller 78 first checks to see if the water temperature, $T_w$, as indicated by the water temperature sensor 40, is less than the set point, $T_{SP}$. The controller may also verify pilot burner 58 operation, as a prerequisite to further operation.

If $T_w$ is less than the set point $T_{SP}$, the controller 78 actuates the gas valve 76 to an open position, thereby igniting the burner 34 via the pilot burner 58, starts a clock or timer function at time $t_0$, and records an initial combustion chamber temperature $T_0$.

At a first time, $t_1$, from opening the gas valve 76, the controller 78 monitors the temperature signal, $T_1$, from the combustion chamber temperature sensor 62 and compares the actual temperature change ($T_1-T_0$), to a required change in temperature, $\Delta T_1$, that is stored in the memory portion 86. If ($T_1-T_0$) is greater than or equal to $\Delta T_1$, the controller 78 allows the gas valve 76 to stay open, and the burner 34 continues heat-up. If ($T_1-T_0$) is less than $\Delta T_1$, the controller 78 shuts the gas valve 76, thereby stopping the flow of gas to the burner 34 and stopping heatup. $t_1$ may be, for example, two minutes from opening the gas valve 76. $\Delta T_1$ may be, for example, approximately 12 degrees Fahrenheit.

If the water temperature set point has not been reached, the system 74 continues to operate until time $t_2$. At time $t_2$ the controller 78 again monitors a temperature signal, $T_2$, from the combustion chamber temperature sensor 62 and compares the actual temperature change since $t_0$, ($T_2-T_0$), to a required change in temperature, $\Delta T_2$, that is stored in the memory portion 86. If ($T_2-T_0$) is greater than or equal to $\Delta T_2$, the controller 78 allows the gas valve 76 to remain open and the burner 34 continues heat-up. If ($T_2-T_0$) is less than $\Delta T_2$, the controller 78 shuts the gas valve 76, thereby stopping the flow of gas to the burner 34. $t_2$ may be, for example, five minutes from opening the gas valve. $\Delta T_2$ may be, for example, approximately 33 degrees Fahrenheit.

If the water temperature set point $T_{SP}$ has not been reached at time $t_3$, the controller 78 yet again monitors a temperature ($T_3$) signal from the combustion chamber temperature sensor 62. This time, unlike at $t_1$ and $t_2$, the temperature $T_3$ is compared to a minimum combustion chamber temperature $T_{MIN}$ stored in the memory portion 86. If $T_3$ is greater than $T_{MIN}$, burner operation continues until the set point $T_{sp}$ is attained. However, if $T_3$ is less than $T_{MIN}$, the controller 78 shuts the gas valve 76, thereby stopping the flow of gas to the burner 34. $t_3$ may be, for example, approximately 20 minutes from opening the gas valve 76. $T_{MIN}$ may be, for example, approximately 218 degrees Fahrenheit.

It is recognized, however, that for certain cold water inlet temperatures (e.g., 40 degrees Fahrenheit or less) and for certain ambient air conditions, condensation may accumulate within the combustion chamber 24 and on the burner 34. Under these conditions, the condensation may inhibit heat-up and prevent an otherwise normal functioning burner from attaining $T_{MIN}$. Therefore, for the first heating cycle after an event such as, for example, initial installation, the check at $t_3$ may be ignored by the processor because the failure to attain $T_{MIN}$ may be a result of condensation rather than LDO or other failure modes. Examples of other events include restoration of power following a loss of power to the controller or restoration of gas supply after extended shutdown periods.

Figure 5:
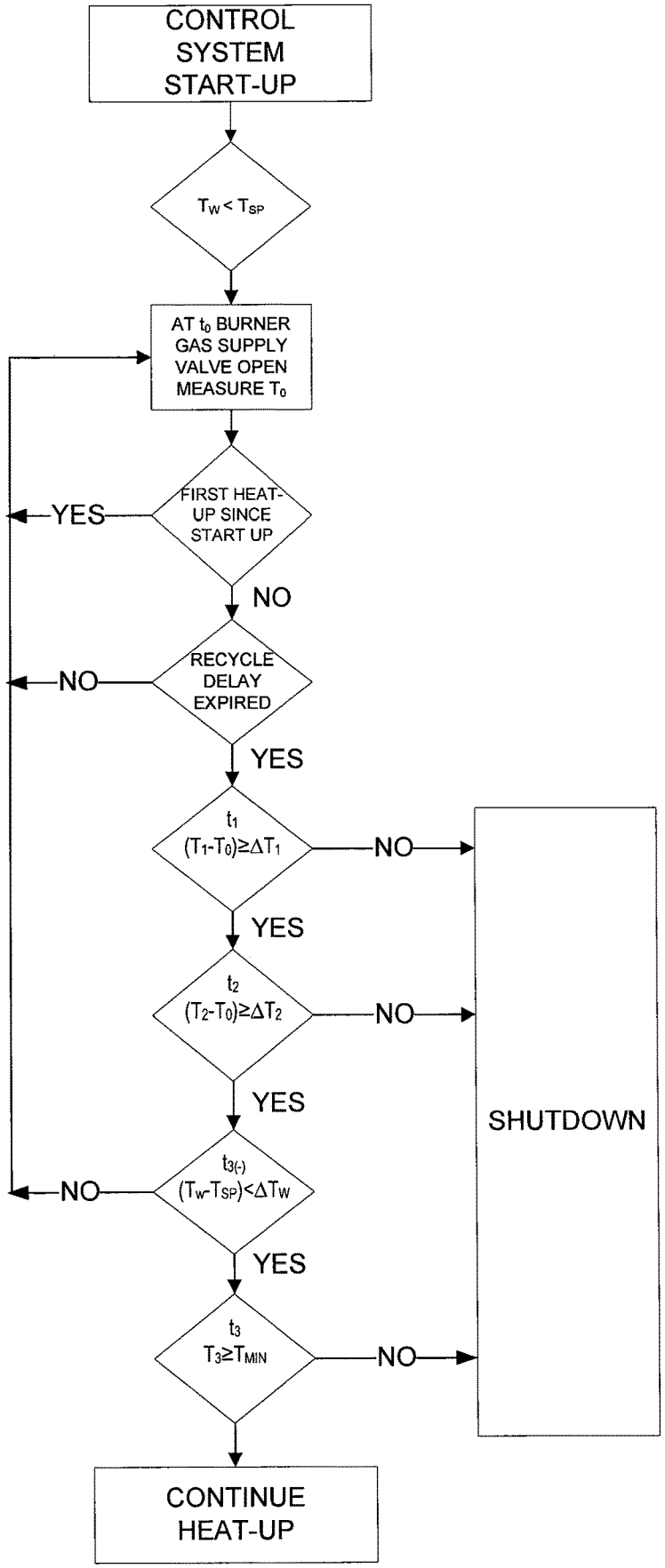
FIG. 5 is a flow chart illustrating a control algorithm for a gas-fired appliance, according to another aspect of the invention.

FIG. 5 is a flow chart illustrating a control algorithm for a control module according to another aspect of the invention. Simultaneous reference is made to FIGS. 1, 3, and 5 for the following description.

Upon system 74 startup, the controller 78 first checks to see if the water temperature, $T_w$, as indicated by the water temperature sensor 40, is less than the set point, $T_{sp}$. The controller 78 may also verify pilot burner 58 operation, as a prerequisite to further operation.

If $T_w$ is less than $T_{sp}$, the controller 78 actuates the gas valve to an open position, thereby igniting the burner 34 via the pilot burner 58, starts a clock or timer function at time $t_0$, and records an initial combustion chamber temperature $T_0$.

On the initial call for heat after a system event such as initial installation, restoration of power, or anytime there is a call for heat after a loss and restoration of pilot, for example, the algorithm ignores the combustion chamber time/temperature rise waypoints described below. This function may be described as "warm-up mode" due its relevance to initial system startup.

Furthermore, the algorithm of FIG. 5 includes a recycle delay function. The recycle delay requires that period of time (e.g., 15 minutes) expire before the subsequent portions of the algorithm can be initiated. The recycle delay inhibits the subsequent time/temperature checks of the algorithm from causing a water heater shutdown due to already-elevated temperatures within the combustion chamber 24. The recycle delay may also inhibit undesirable water heater shutdowns when a temperature set point is manually adjusted during a call for heat. Furthermore, when a set point has been achieved and the recycle delay has expired, if a higher set point is initiated, the algorithm ignores the warm up mode but runs the check combustion chamber temperature at a predefined time.

At a first time from opening the gas valve, $t_1$, the controller 78 monitors the temperature signal $T_1$ from the combustion chamber temperature sensor 62 and compares the actual temperature change ($T_1-T_0$) to a required change in temperature, $\Delta T_1$, that is stored in the memory portion 86. If ($T_1-T_0$) is greater than or equal to $\Delta T_1$, the controller 78 allows the gas valve 76 to stay open, and the burner 34 continues heat-up. If ($T_1-T_0$) is less than $\Delta T_1$, the controller 78 shuts the gas valve 76, thereby stopping the flow of gas to the burner 34 and stopping heatup. $t_1$ may be, for example, nine minutes from opening the gas valve 76. $\Delta T_1$ may be, for example, approximately 37 degrees Fahrenheit.

If the water temperature set point has not been reached, the system 74 continues to operate until time $t_2$. At time $t_2$, the controller 78 again monitors a temperature signal, $T_2$, from the combustion chamber temperature sensor 62 and compares the actual temperature change since $t_0$, $(T_2-T_0)$, to a required change in temperature, $\Delta T_2$. $\Delta T_2$ may be stored in the memory portion 86. If $(T_2-T_0)$ is greater than or equal to $\Delta T_2$, the controller 78 allows the gas valve 76 to stay open and the burner 34 continues heat-up. If $(T_2-T_0)$ is less than $\Delta T_2$, the controller 78 shuts the gas valve 76, thereby stopping the flow of gas to the burner 34. $t_2$ may be, for example, 13 minutes from opening the gas valve 76. $\Delta T_2$ may be, for example, approximately 45 degrees Fahrenheit.

Just before a third time/temperature check, at time $t_{3(-)}$, the controller 78 pauses and check the water temperature $T_W$. If the difference between the set point temperature and the current water temperature $(T_{SP}-T_W)$ is less than a predetermined difference $(\Delta T_W)$, then the algorithm proceeds to the third time/temperature check at time $t_3$. If $(T_{SP}-T_W)$ is greater than or equal to $\Delta T_W$, then this may be an indication that condensation is present in the combustion chamber 24. $\Delta T_W$, may be, for example, approximately 5 degrees Fahrenheit. $t_{3(-)}$ may be, for example, one second before the third time/temperature check at $t_3$.

If the water temperature has not been reached, at time $t_3$, the controller 78 yet again monitors a temperature signal $T_3$ from the combustion chamber temperature sensor. This time, unlike at $t_1$ and $t_2$, the temperature $T_3$ is compared to a minimum combustion chamber temperature $T_{MIN}$ stored in the memory portion 86. If $T_3$ is greater than $T_{MIN}$, burner operation continues until the set point is attained. However, if $T_3$ is less than $T_{MIN}$, the controller shuts the gas valve, thereby stopping the flow of gas to the burner. $t_3$ may be, for example, 20 minutes from opening the gas valve. $T_{MIN}$ may be, for example, approximately 200 degrees Fahrenheit.

Thus, the invention provides, among other things, a new and useful gas-fired appliance and a control algorithm for the same. Various features and advantages of the invention are set forth in the following claims.

What is claimed is:

1. A gas-fired water heater, comprising:

a water tank including a water inlet and a water outlet;

a combustion chamber;

a burner assembly disposed within the combustion chamber, the burner assembly for providing a heat to the water tank;

a gas valve for controllably supplying gas to the burner assembly;

a temperature sensor coupled to the combustion chamber, the temperature sensor generating a signal related to the temperature of the combustion chamber; and a controller having an electronic processor and memory, the controller configured to:

receive the signal at a first predetermined time and at a second predetermined time;

calculate a rate of change in temperature based on the signal received at the first predetermined time and the signal received at the second predetermined time;

compare the rate of change in temperature to a rate of change threshold to produce a first comparison;

shut the gas valve in response to the rate of change in temperature being less than the rate of change threshold;

receive the signal at a third predetermined time in response to the rate of change in temperature being equal to or greater than the rate of change threshold;

calculate a second rate of change in temperature based on the signal received at the first predetermined time and the signal received at the third predetermined time;

compare the second rate of change in temperature to a second rate of change threshold to produce a second comparison; and shut the gas valve in response to the second rate of change in temperature being less than the second rate of change threshold, wherein the controller is configured to ignore the second comparison when the gas valve has been opened for a first time since an event.

2. The gas-fired water heater of claim 1, wherein the event corresponds to an accumulation of condensation within the combustion chamber.

3. The gas-fired water heater of claim 1, wherein the first predetermined time occurs upon opening the gas valve in response to the signal.

4. The gas-fired water heater of claim 1, wherein the combustion chamber includes a combustion chamber door, and further wherein the temperature sensor is coupled to the combustion chamber door.

5. The gas-fired water heater of claim 1, wherein the controller is further configured to calculate a third rate of change in temperature based on the signal received at the first predetermined time and the signal received at a fourth predetermined time, compare the third rate of change in temperature to a third rate of change threshold, and controllably shut the gas valve in response to the third rate of change in temperature being less than the third rate of change threshold.

6. The gas fired water heater of claim 1, wherein the event includes initial system installation.

7. The gas fired water heater of claim 2, wherein the event includes restoration of power to the controller, following a loss of power to the controller.

8. The gas-fired water heater of claim 1, further comprising a pilot burner assembly, the pilot burner assembly generating a second signal, wherein the controller opens the gas valve in response to the signal and the second signal.

9. The gas-fired water heater of claim 1, wherein the controller and the gas valve comprise a unitary control module of the gas-fired water heater.

* * * * *